US007662200B2

(12) United States Patent
Knuth et al.

(10) Patent No.: US 7,662,200 B2
(45) Date of Patent: Feb. 16, 2010

(54) VACUUM BAG MOUNTING AND VIEWING FEATURES

(75) Inventors: Steven L. Knuth, Saybrook, IL (US); Donald J. Davidshofer, Bloomington, IL (US); Randall Sandlin, Bloomington, IL (US)

(73) Assignee: Electrolux Home Care Products, Inc., Cleveland, OH (US)

( * ) Notice: Subject to any disclaimer, the term of this patent is extended or adjusted under 35 U.S.C. 154(b) by 554 days.

(21) Appl. No.: 11/582,382

(22) Filed: Oct. 18, 2006

(65) Prior Publication Data

US 2007/0113528 A1 May 24, 2007

Related U.S. Application Data

(60) Provisional application No. 60/727,514, filed on Oct. 18, 2005.

(51) Int. Cl.
*B01D 45/12* (2006.01)

(52) U.S. Cl. ..... 55/373; 15/347; 55/374; 55/376; 55/378; 55/DIG. 3

(58) Field of Classification Search ..... 55/337, 55/345, 361, 373, 374, 376, 378, 426, 429, 55/459.1, 472, 482, 525, DIG. 3, DIG. 2; 15/350, 347, 352, 353
See application file for complete search history.

(56) References Cited

U.S. PATENT DOCUMENTS

| | | | |
|---|---|---|---|
| 1,029,562 | A | 6/1912 | Prentiss |
| 2,755,883 | A | 7/1956 | Brace |
| 2,975,862 | A | 3/1961 | Goldberg |
| 3,350,858 | A | 11/1967 | Verhagen |
| 3,432,998 | A | 3/1969 | Downey |
| 3,577,869 | A | 5/1971 | Hosokawa et al. |
| 3,731,465 | A | 5/1973 | Ohira et al. |

(Continued)

FOREIGN PATENT DOCUMENTS

| | | |
|---|---|---|
| DE | 1959657 | 2/1967 |

(Continued)

*Primary Examiner*—Duane Smith
*Assistant Examiner*—Minh-Chau T Pham
(74) *Attorney, Agent, or Firm*—Hunton & Williams

(57) ABSTRACT

A vacuum cleaner dirt containment system with a bag chamber having an open end, an outlet adapted to be in fluid communication with a vacuum fan inlet located on the vacuum cleaner housing, and a plurality of locator ribs extending from an inner wall of the bag chamber. Each locator rib has a landing adjacent an inner wall of the bag chamber, and a pin located inward of the landing and extending from the landing towards the open end of the bag chamber. A filter bag assembly is adapted to be inserted into the bag chamber, and has a flange attached to an open end of a permeable filter bag. A flange air inlet passes through the flange into the bag. The flange has openings located to be inserted over the locator rib pins, and support segments located to abut the locator rib landings. The lid is selectively attachable to the open end of the bag chamber, and includes an air inlet mounting tube that extends into the flange air inlet when the lid is attached to the open end of the bag chamber. A bag having locating features and variations of the foregoing are also provided.

24 Claims, 14 Drawing Sheets

U.S. PATENT DOCUMENTS

| | | | | |
|---|---|---|---|---|
| 3,821,830 | A | | 7/1974 | Sundheim |
| 3,907,671 | A | | 9/1975 | Baigas, Jr. |
| 3,919,729 | A | | 11/1975 | Cannan |
| 3,942,217 | A | | 3/1976 | Bates |
| 3,990,872 | A | | 11/1976 | Cullen |
| 4,103,390 | A | | 8/1978 | Tucker |
| 4,105,420 | A | | 8/1978 | Moore |
| 4,114,229 | A | | 9/1978 | Jones et al. |
| 4,262,384 | A | | 4/1981 | Bowers |
| 4,311,492 | A | | 1/1982 | Eltvedt |
| 4,416,033 | A | | 11/1983 | Specht |
| 4,452,618 | A | | 6/1984 | Kuplas |
| 4,532,670 | A | | 8/1985 | Fortune |
| 4,542,556 | A | | 9/1985 | Hepple |
| 4,559,665 | A | | 12/1985 | Fitzwater |
| 4,570,286 | A | | 2/1986 | Ross |
| 4,584,733 | A | | 4/1986 | Tietge et al. |
| 4,735,697 | A | | 4/1988 | Burton |
| 4,748,713 | A | | 6/1988 | Sepke et al. |
| 4,800,615 | A | | 1/1989 | Ostroski et al. |
| 4,821,366 | A | | 4/1989 | Levine |
| 4,858,269 | A | | 8/1989 | Ostroski et al. |
| 4,920,608 | A | | 5/1990 | Hult et al. |
| 4,939,809 | A | | 7/1990 | Park |
| 5,020,186 | A | | 6/1991 | Lessig, III et al. |
| 5,065,473 | A | | 11/1991 | Krasznai et al. |
| 5,089,038 | A | | 2/1992 | Kopco et al. |
| 5,213,595 | A | | 5/1993 | Kim |
| 5,223,010 | A | | 6/1993 | Saunders et al. |
| 5,263,225 | A | | 11/1993 | Winters |
| 5,355,549 | A | | 10/1994 | Steinberg et al. |
| 5,382,063 | A | | 1/1995 | Wesener et al. |
| 5,411,150 | A | | 5/1995 | Sigurdsson |
| 5,438,729 | A | | 8/1995 | Powell |
| 5,472,460 | A | | 12/1995 | Schmierer |
| 5,472,465 | A | | 12/1995 | Schmierer |
| 5,528,787 | A | | 6/1996 | Cutler |
| 5,531,802 | A | | 7/1996 | Schlor et al. |
| 5,544,385 | A | | 8/1996 | Jailor et al. |
| 5,546,631 | A | | 8/1996 | Chambon |
| 5,720,068 | A | | 2/1998 | Clark et al. |
| 5,747,764 | A | | 5/1998 | Son et al. |
| 5,755,009 | A | | 5/1998 | Stephens et al. |
| 5,779,744 | A | | 7/1998 | Mueller et al. |
| 5,792,224 | A | | 8/1998 | Fu et al. |
| 5,802,666 | A | | 9/1998 | Jung |
| 5,806,238 | A | | 9/1998 | Brenner et al. |
| 5,832,559 | A | | 11/1998 | Kang |
| 5,862,737 | A | | 1/1999 | Chiu et al. |
| 5,863,309 | A | * | 1/1999 | Louis et al. ..... 55/368 |
| 5,884,358 | A | | 3/1999 | Kim |
| 5,893,195 | A | | 4/1999 | Jung |
| 5,894,629 | A | | 4/1999 | Kim |
| 5,970,572 | A | | 10/1999 | Thomas |
| 5,991,971 | A | | 11/1999 | Downham |
| 6,013,121 | A | | 1/2000 | Chiu et al. |
| 6,029,309 | A | | 2/2000 | Imamura |
| 6,033,451 | A | | 3/2000 | Fish et al. |
| 6,167,587 | B1 | | 1/2001 | Kasper et al. |
| 6,170,118 | B1 | | 1/2001 | McIntyre et al. |
| 6,192,548 | B1 | | 2/2001 | Huffman |
| 6,210,457 | B1 | | 4/2001 | Siemers |
| 6,256,832 | B1 | | 7/2001 | Dyson |
| 6,286,181 | B1 | | 9/2001 | Kasper et al. |
| 6,289,552 | B1 | | 9/2001 | McCormick |
| 6,368,373 | B1 | | 4/2002 | Mueller |
| 6,379,408 | B1 | | 4/2002 | Embree et al. |
| 6,412,141 | B2 | | 7/2002 | Kasper et al. |
| 6,438,793 | B1 | | 8/2002 | Miner et al. |
| 6,513,189 | B1 | | 2/2003 | Berry |
| 6,530,114 | B2 | | 3/2003 | Bailey et al. |
| 6,733,555 | B1 | | 5/2004 | Wilder |
| 6,792,647 | B2 | * | 9/2004 | Park et al. ..... 15/351 |
| 6,802,879 | B2 | | 10/2004 | Scanlon |
| 6,948,211 | B2 | | 9/2005 | Stephens et al. |
| 7,024,724 | B2 | | 4/2006 | Ponjican et al. |
| 7,247,181 | B2 | * | 7/2007 | Hansen et al. ..... 55/337 |
| 7,410,535 | B2 | * | 8/2008 | Song et al. ..... 96/385 |
| 2003/0037405 | A1 | | 2/2003 | Moine et al. |
| 2005/0138763 | A1 | | 6/2005 | Tanner et al. |

FOREIGN PATENT DOCUMENTS

| | | |
|---|---|---|
| DE | 2533590 | 2/1977 |
| DE | 3403135 | 8/1985 |
| DE | 9012439 | 10/1990 |
| DE | 9017798 | 2/1992 |
| DE | 19711611 | 3/1997 |
| DE | 20119853 | 3/2002 |
| EP | 0202639 | 5/1986 |
| EP | 0765628 | 4/1997 |
| FR | 1387792 | 12/1964 |
| FR | 2800980 | 11/1999 |
| GB | 1080527 | 8/1967 |
| GB | 1430674 | 3/1976 |
| GB | 1481154 | 7/1977 |
| GB | 1489555 | 10/1977 |
| WO | WO 00/35331 | 6/2000 |
| WO | WO 02/24047 | 3/2002 |

* cited by examiner 100
106
130
125
110
114
122
112
113
110
101
104
108

130
132
114
125
124
126
122
128
301
301
120
112
113
118
106
110
101

VACUUM BAG MOUNTING AND VIEWING FEATURES

CLAIM OF PRIORITY

This patent claims priority to U.S. Provisional Application No. 60/727,514, filed on Oct. 18, 2005, which is incorporated herein by reference in its entirety.

FIELD OF THE INVENTION

The present invention relates to vacuum cleaners, extraction cleaning devices, and other cleaning appliances having dust collecting bags or filters.

BACKGROUND OF THE INVENTION

Many types of cleaning devices are available for commercial and consumer cleaning needs. For example, conventional vacuums are often used for general floor cleaning and various types of extraction cleaners have been developed to provide deeper or more problem-specific carpet and upholstery cleaning.

A common problem among these and other cleaning appliances is that supplies such as replacement bags or filters are often installed incorrectly. Such problems can result in reduced effectiveness in the appliance retaining the dust and dirt that it collects, and customer dissatisfaction with the device. This problem may also present a health risk as unwanted dust and dirt are potentially blown into the air.

In view of this and other problems, there remains a need to provide improved methods and apparatuses for providing vacuum cleaner bags and other filters.

SUMMARY OF THE INVENTION

In one aspect, a vacuum cleaner dirt containment system is provided. The exemplary vacuum cleaner dirt containment system has a bag chamber associated with a vacuum cleaner housing, a filter bag, and a lid. The bag chamber has an open end, an outlet adapted to be in fluid communication with a vacuum fan inlet located on the vacuum cleaner housing, and a plurality of locator ribs extending from an inner wall of the bag chamber. Each locator rib has a landing adjacent an inner wall of the bag chamber, and a pin located inward of the landing and extending from the landing towards the open end of the bag chamber. The filter bag assembly is adapted to be inserted into the open end of the bag chamber, and includes a bag formed at least partially of an air-permeable material, and a flange attached to an open end of the bag and having a flange air inlet passing through the flange into the bag. The flange has a number of openings located to be inserted over one or more of the locator rib pins, and a number of support segments located to abut one or more of the locator rib landings when the openings are located over the locator rib pins. The lid is selectively attachable to the open end of the bag chamber, and includes an air inlet mounting tube that extends into the flange air inlet when the lid is attached to the open end of the bag chamber.

In another aspect, a vacuum cleaner filter bag is provided. The exemplary vacuum cleaner filter bag has a bag formed at least partially of an air-permeable material, and a flange attached to an open end of the bag. The flange has a flange air inlet passing through the flange into the bag, and one or more discrete openings adapted to facilitate proper alignment of the filter bag.

In still another aspect, a vacuum cleaner dirt containment system is provided. The exemplary vacuum cleaner dirt containment system includes a bag chamber, a filter bag assembly, and a lid. The bag chamber is removably associated with a vacuum cleaner housing, and has an open end and an outlet adapted to be in fluid communication with a vacuum fan inlet located on the vacuum cleaner housing. The filter bag assembly is adapted to be inserted into the open end of the bag chamber, and includes a bag formed at least partially of an air-permeable material, and a flange attached to an open end of the bag. A flange air inlet passes through the flange into the bag. The lid is selectively attachable to the open end of the bag chamber, and has an air inlet mounting tube that extends into the flange air inlet when the lid is attached to the open end of the bag chamber. The flange is captured in place between the bag chamber and the lid.

The foregoing aspects are exemplary only, and not intended to limit the claimed invention. Other uses and variations on the foregoing will be apparent to one of ordinary skill in the art after studying the present disclosure and practicing the inventions described herein.

DETAILED DESCRIPTION OF THE PREFERRED EMBODIMENTS

The present invention provides methods and apparatuses for properly installing and securing a filter bag or other filter, as are typically used in vacuum cleaners. The filter bag generally comprises a flange having one or multiple correct positions for installing the filter bag or filter into a device in which it is intended to be installed. Such a flange facilitates filter bag installation and, in the event of an incorrect installation, may provide positive feedback to the operator that corrective action is required to properly fit the filter bag or filter. Such positive feedback may include, for example, a visibly improper seating in the filter bag or filter receptacle, or an interference with other parts, such as a lid, and would thereby yield an easily recognizable improper assembly of the cleaning device. For purposes of clarity, all embodiments detailed in the present specification pertain to filter bag filter that are commonly used in bag vacuums, however, the present invention can easily be utilized with a wide variety of other filters, such as pleated filters used in cyclonic vacuums, pre- and post-motor filters, and the like. The filter bag or filter of the present invention may be used with a variety of cleaning devices, such as bag or bagless vacuums, wet extractors, canister-type cleaners, wet/dry vacuums, central vacuum systems, accessory tools, and hand-held and other types of portable cleaners. Examples of such devices are shown in U.S. Pat. Nos. 6,856,113; 6,558,453; 6,481,048; 6,311,366; 6,308,374; and 5,933,912, which are incorporated herein by reference.

Figure 1:
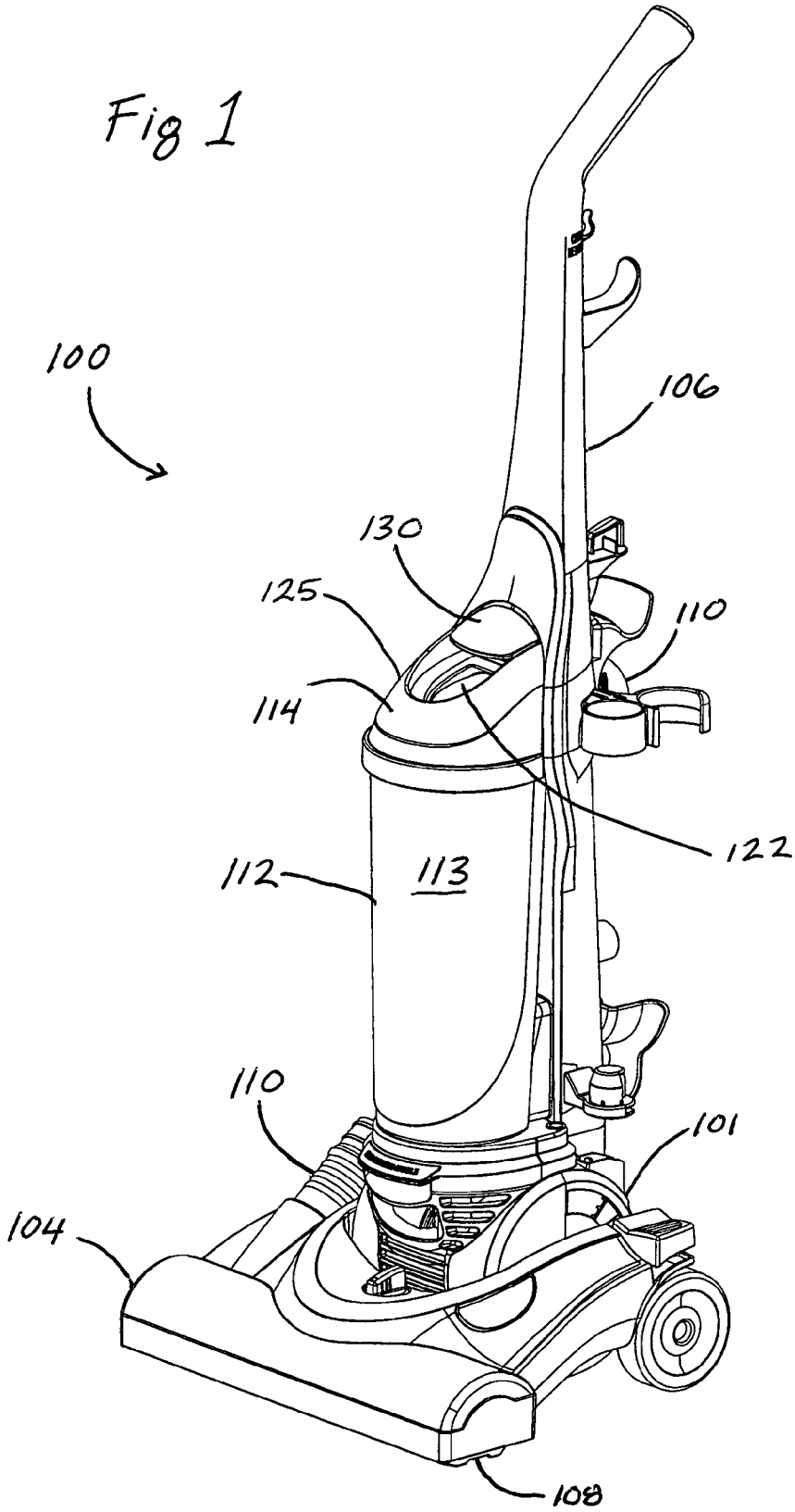
FIG. 1 is a perspective view of an embodiment of an upright vacuum of the present invention.

Referring to the included Figures, in a first embodiment, the present invention provides an upright vacuum cleaner 100 that utilizes a filter bag 102 (see, e.g., FIG. 8) for collecting dust and debris. The vacuum cleaner of FIG. 1 is generally of conventional construction, and includes a floor-contacting base 104 to which an upright rear housing 106 is pivotally attached. The rear housing 106 can be positioned in an upright resting position and leaned back for use in guiding the base 104 across the surface being cleaned, as known in the art. The base includes an inlet nozzle 108, which may have a rotatable agitator (not shown) mounted therein.

The nozzle 108 is connected to the filter bag 102 by an inlet conduit 110. A typical inlet conduit 110 comprises a series of rigid and/or flexible tubes. In the shown embodiment, the inlet conduit 110 comprises a first rigid tube protruding from the base 104, and a second rigid tube (FIG. 3) that extends into the rear housing. A flexible hose (not shown) extends between the inlet conduits 110. All or a portion or the conduit 110 may be transparent to help locate clogs, and a portion of the conduit 110 may be removable to assist with cleaning clogs therefrom. An example of a conduit 110 having a transparent, removable portion is shown in U.S. Pat. No. 5,991,791, which is incorporated herein by reference. The inlet conduit 110 may be detachable from the base 104 for use as an above-floor cleaning hose, or may include a valve that cuts off airflow from the inlet 108 and redirects the airflow to a separate above-floor cleaning hose. Such devices are known in the art.

A conventional vacuum fan and motor assembly is located in a motor housing 101, which may be located in the base 104 or the rear housing 106. The vacuum fan is used to generate a vacuum to draw dirt-laden air into the nozzle 108, through the conduit 110, and into the filter bag 102. In other embodiments, the vacuum fan may be remote from the remainder of the device, as may be the case in central vacuum cleaners. The fan may be fluidly located at some point in the conduit 110 to convey the dirt-laden air to the filter bag 102 under positive pressure, or may be located downstream of the filter bag 102 to draw dirt-laden air into the filter bag 102 under a vacuum as shown in FIG. 1. Additional filters may also be provided in the conduit 110 or at locations downstream of the filter bag 102 to provide additional dirt filtration and air cleaning.

In FIG. 1, the bag chamber lid 114 is shown attached to the to the bag chamber 112. The bag chamber lid 114 is attached to or pressed against the bag chamber 112 during operation of the vacuum cleaner. Preferably, the assembled bag chamber 112 and lid 114 are removable as a unit from the vacuum cleaner, and the bag chamber lid 114 is at least partially removable from the bag chamber 112 to provide access to the open end of the bag chamber 112 to remove and replace the filter bag 102. One embodiment of the present invention envisions the bag chamber lid 114 as a completely separate part from the bag chamber 112. However, another embodiment provides a bag chamber lid 114 that is pivotally attached to the cup by a hinge, slideably attached to the bag chamber 112, or otherwise movably attached to the cup. Finally, in other embodiments, the bag chamber lid 114 may be affixed to or associated with the body of the associated vacuum cleaner. Other variations, or combinations of these variations may also be used.

Figure 2:
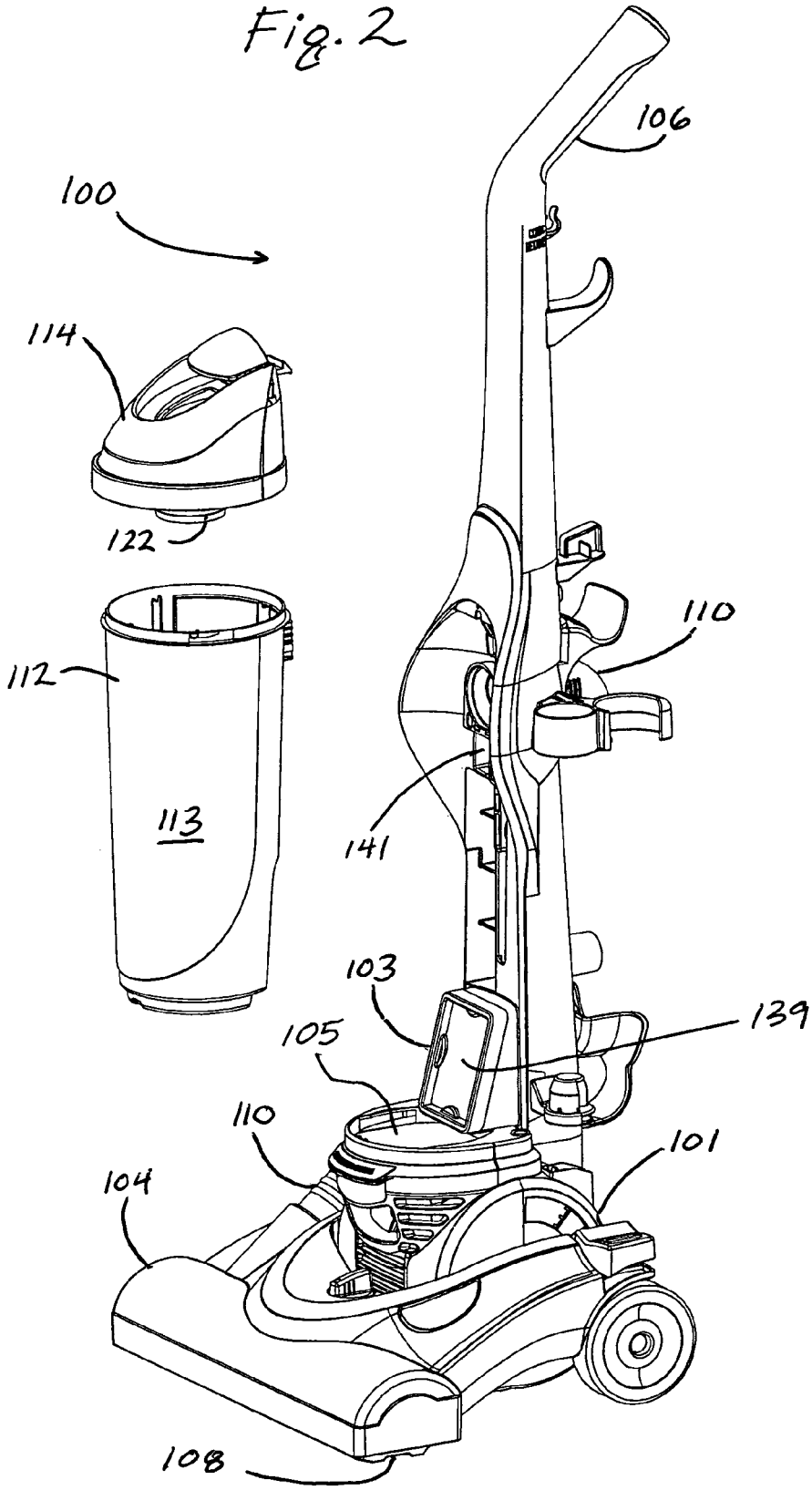
FIG. 2 is a perspective view of the embodiment of FIG. 1, shown with the bag chamber assembly shown in exploded view.

Referring now to FIG. 2, the filter bag 102 (FIG. 8) preferably is located within a bag chamber 112 on the rear housing 106. The bag chamber 112 is covered by a suitable lid 114. The chamber 112 and/or lid 114 may optionally be replaced by or include an air-permeable fabric cover as may be desired when the vacuum fan is positioned to convey the air into the filter bag 102 under pressure. In FIG. 2, the vacuum fan draws air through the bag chamber 112 under negative pressure, and the vacuum fan inlet 103 can be seen located near the bottom of the bag chamber 112. A filter 139 is located over the vacuum fan inlet 103, as described in grater detail elsewhere herein. As shown in FIG. 1, the vacuum fan inlet 103 is positioned adjacent a platform 105 upon which the bag chamber 112 rests when installed to the rear housing 106.

Figure 3:
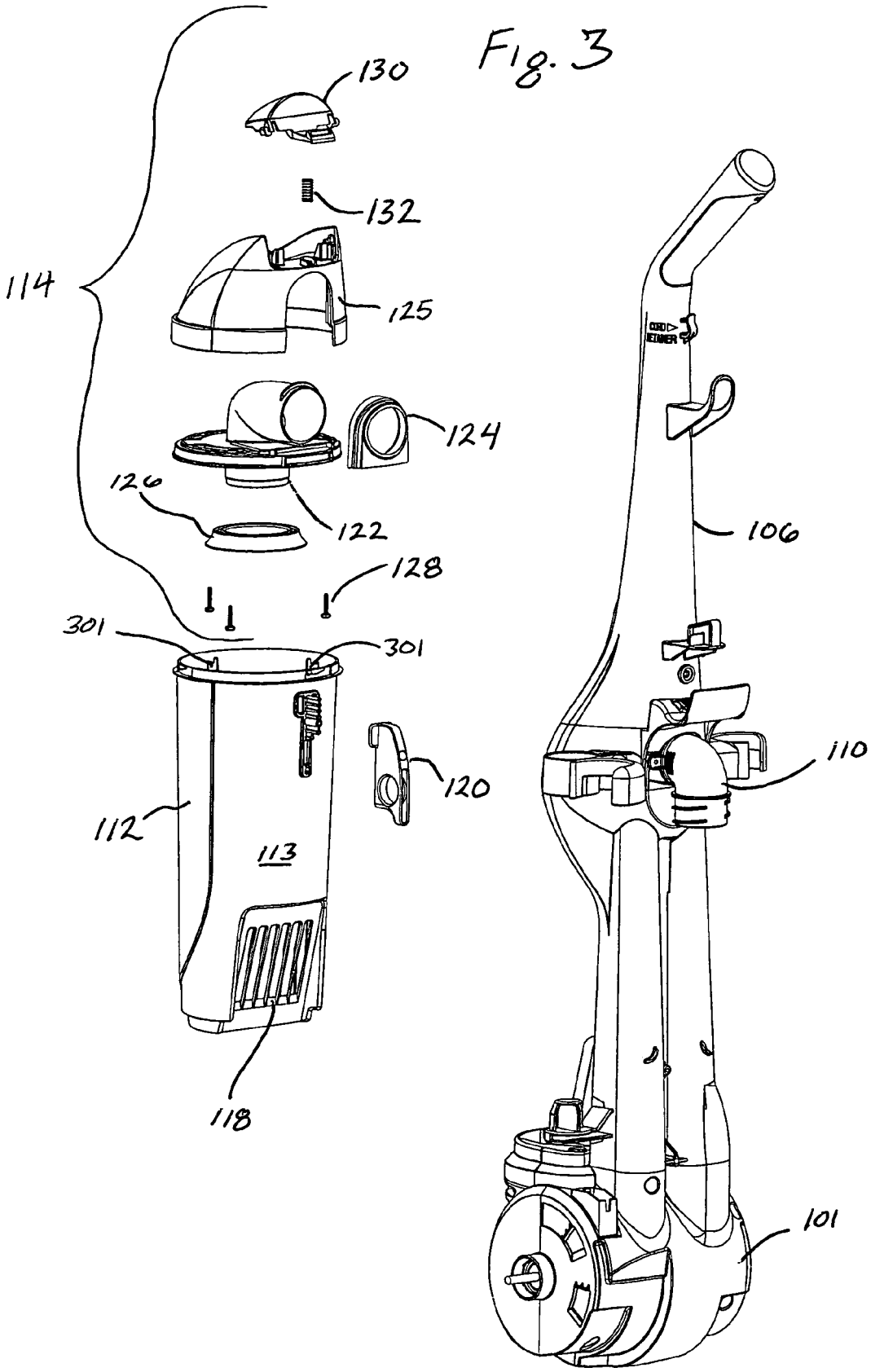
FIG. 3 is a rear perspective view of the embodiment of FIG. 1, shown with the bag chamber assembly in exploded view and the floor nozzle omitted.

Referring now to FIG. 3, the details of the exemplary embodiment of a bag chamber 112 are explained. The bag chamber 112 may be constructed of clear or opaque plastic (or a combination thereof), and is preferably removable from the rear housing 106. The bag chamber 112 is also envisioned to stand on its own when removed from the vacuum cleaner so as not to spill any previously collected dust. Alternatively, the bag chamber 112 may be permanently attached to the vacuum cleaner. The bag chamber 112 also possesses one or more sidewalls 113, with an open upper end capable of accepting a filter bag 102 (FIG. 8), and outlet 118, and, if desired, a handle 120. The handle 120 preferably extends from the outer surface of the bag chamber 112 to provide a gripping feature for easy carrying of the bag chamber 112. This handle 120 cooperates with a void area 141 of the vacuum cleaner rear housing (not shown) to help position the bag chamber 112 to the rear housing 106 for proper mounting. In a preferred embodiment, the outlet 118 is provided with a grill or other structure to prevent the filter bag 102 from exiting the bag chamber 112. The outer perimeter of the outlet 118 preferably cooperates in sealing against a resilient gasket 134 (FIG. 5), upstream of the fan and motor assembly. It is also appreciated that a filter may be sealed against this outlet 118 to further separate dust from the vacuum air stream.

The bag chamber lid 114 is provided to close the open upper end of the bag chamber 112. The lid 114 is provided with a mounting tube 122 that is fluidly connected to the end of the conduit 110 when the chamber 112 and lid 114 are attached to the rear housing 106. The mounting tube 122 directs the vacuum air stream into the filter bag 102, which has a hole 152 (FIG. 8) that can be mounted around the mounting tube 122. The lid 114 is provided with rubber conduit gasket 124 to seal the mounting tube 122 to the conduit 110. The lid is further provided with a rubber flange gasket 126 to seal against the mounting tube 122 and the filter bag flange 116 (see FIGS. 10A and 10B). Alternatively, this flange gasket 126 may also be provided in the flange 116 itself, as is known in the art. Together, these two gaskets 124, 126 inhibit any dust-laden air from bypassing the filter bag 102. The lid 114 preferably also includes a lid cover 125 that is assembled to the mounting tube 122 by threaded fasteners 128 or other means that are generally known in the art.

The present invention also encompasses, in one embodiment, a construction in which the mounting tube 122 is constructed of a clear material, such as plastic. This feature allows the operator to view into the tube 122 to determine if there is a clog therein. As shown in FIG. 1, the tube 122 is visible through an opening through the lid cover 125. Such a clear tube 122 may also allow the user to view into the filter bag 102 to determine if it is full and ready for replacement. This alleviates the need to remove any covers or squeeze bags to determine if a filter bag 102 is full. If it is expected that there may be some distortion when looking through the clear tube 122, the tube 122 may be shaped with a flat or lens-like upper outer surface, or other shape, to facilitate viewing into the filter bag 102. A light may also be provided to illuminate the contents of the filter bag 102. Compact LED lights are expected to be particularly useful for this purpose. In a variation of this embodiment, a viewing window may be formed in the lid 114 so that a user can view down into the bag chamber 112, and perhaps into the filter bag 102 as well. The clear tube 122 or viewing window may be separately formed and attached to the device, as shown, or integrally formed by a two-step molding process.

The lid 114 is further provided with a latch 130 to secure the dust chamber 112 and lid 114 assembly to the rear housing 116. The latch is preferably comprises a simple pivoting device having a hook at its end to engage a corresponding structure in the rear housing 106, and a spring 132 to bias the hook into such engagement.

The lid 114 and bag chamber 112 are provided with a locking mechanism to positively and releasably secure the lid 114 to the bag chamber 112. The locking mechanism is of a conventional variety known to those skilled in the art of vacuum cleaners and plastic injection molding. Examples of such devices include integrally-formed bayonet fittings 301 (as shown), threads, snap-fit detents, a separately formed mechanical latch or latches, and so on.

Figure 4:
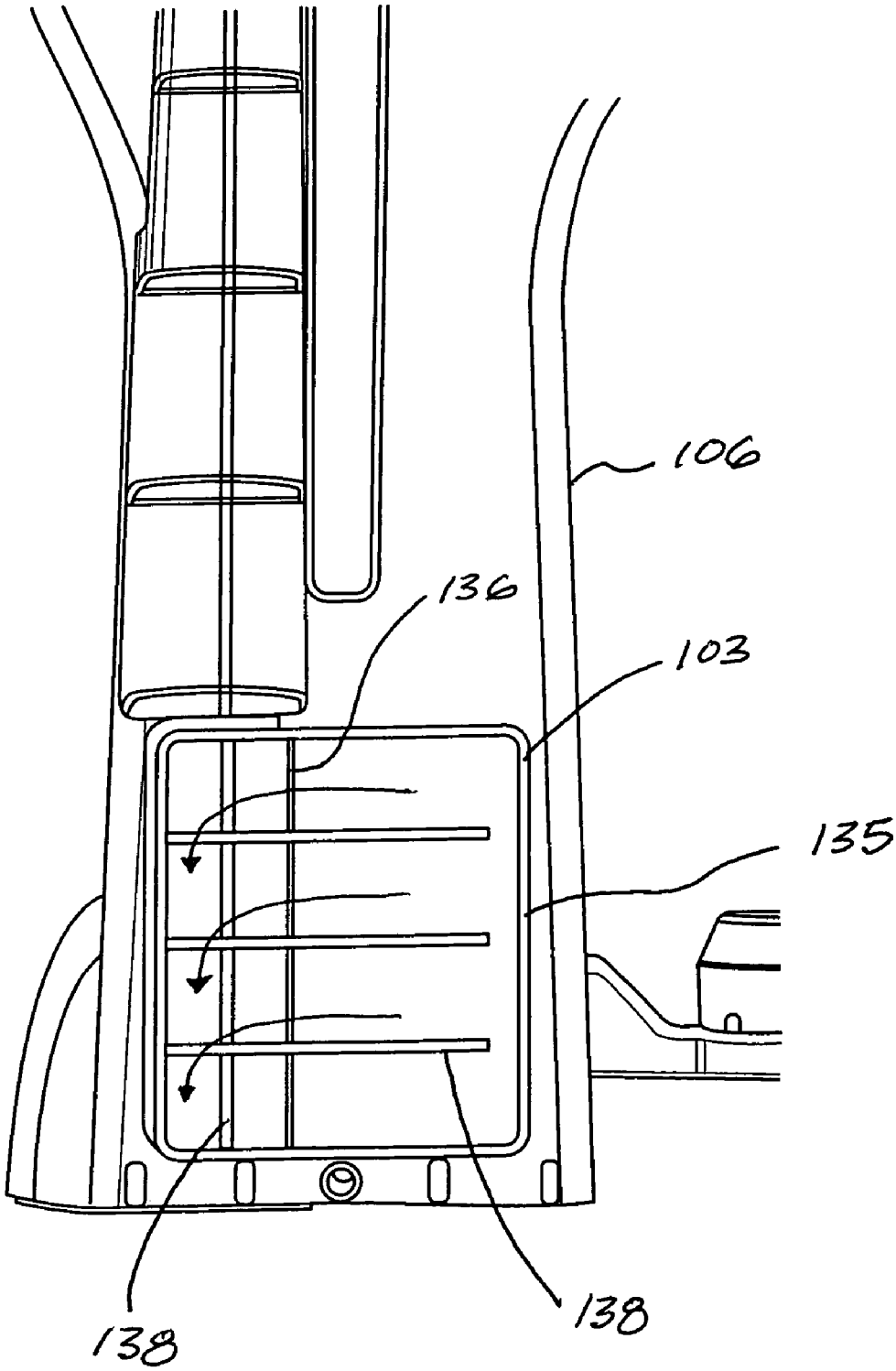
FIG. 4 is a front fragmented view of a fan motor assembly inlet of the embodiment depicted in FIG. 1.

Referring now to FIG. 4, an exemplary fan and motor assembly inlet 103 of a preferred embodiment will now be explained. The inlet 103 is located at a lower end of the rear housing 106 and is in fluid communication with the vacuum fan and motor assembly. The inlet 103 is provided with one or more sidewalls 135 capable of enveloping a volume of air that funnels down into a generally smaller conduit 136 that leads to the fan and motor assembly 101. The inlet 103 is provided with directional flow ribs 138 that guide and direct the incoming air in the direction of the arrows in FIG. 4 towards the conduit 136. The ribs 138 may be designed to enhance the overall flow rate from the inlet 103 to the vacuum fan, if desired.

Figure 5:
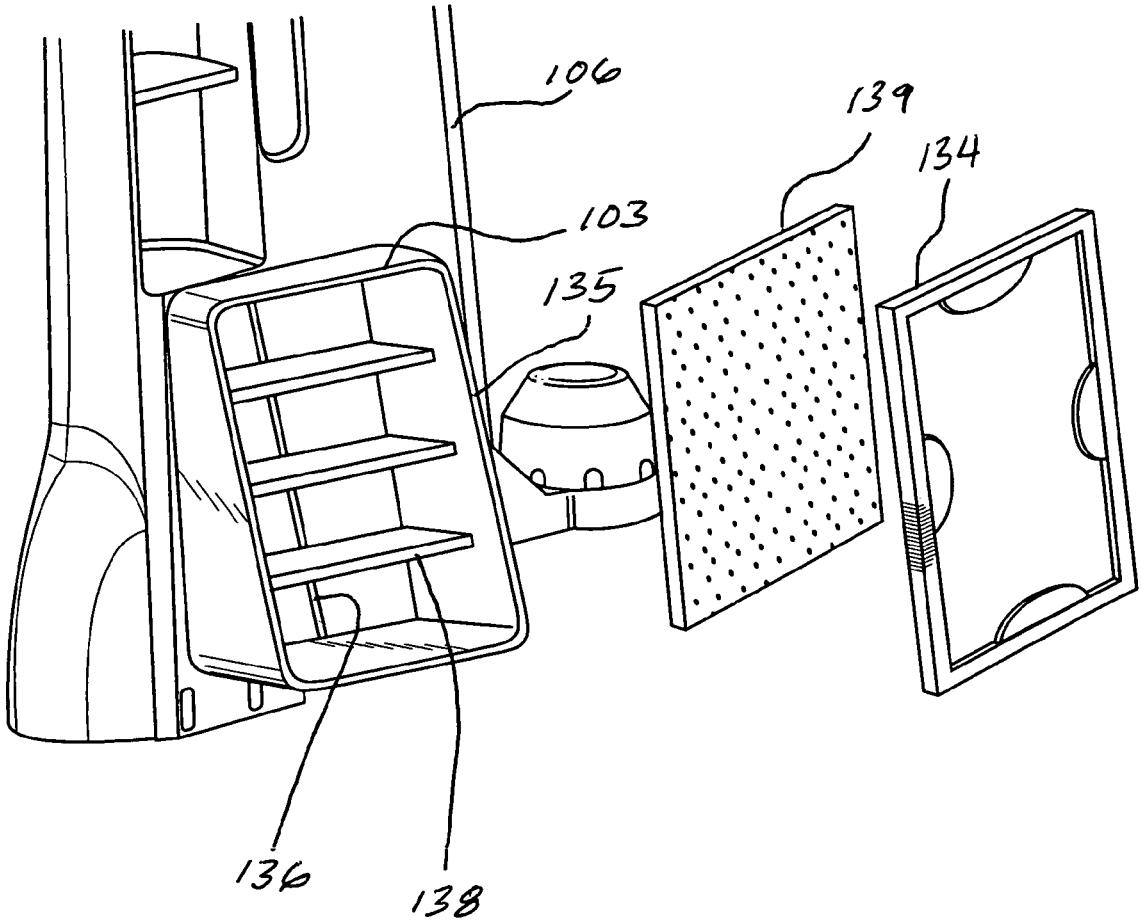
FIG. 5 is an exploded isometric view of an embodiment of a filter assembly of the present invention and the fan motor assembly inlet depicted in FIG. 4.

Referring now to FIG. 5, the inlet 103 is provided with a resilient gasket 134 to maintain a seal between the bag chamber outlet 118 and the inlet sidewalls 135. The gasket 134 is also preferably used in conjunction with a filter 139, which is captured between the gasket 134, the sidewalls 135, and flow ribs 138. The filter 139 may be disposable or reusable, and may provide any grade of filtration, as generally known in the art. The gasket 134 is secured to the sidewalls 135 by a friction fit, detents, or other means known in the art.

Figure 6:
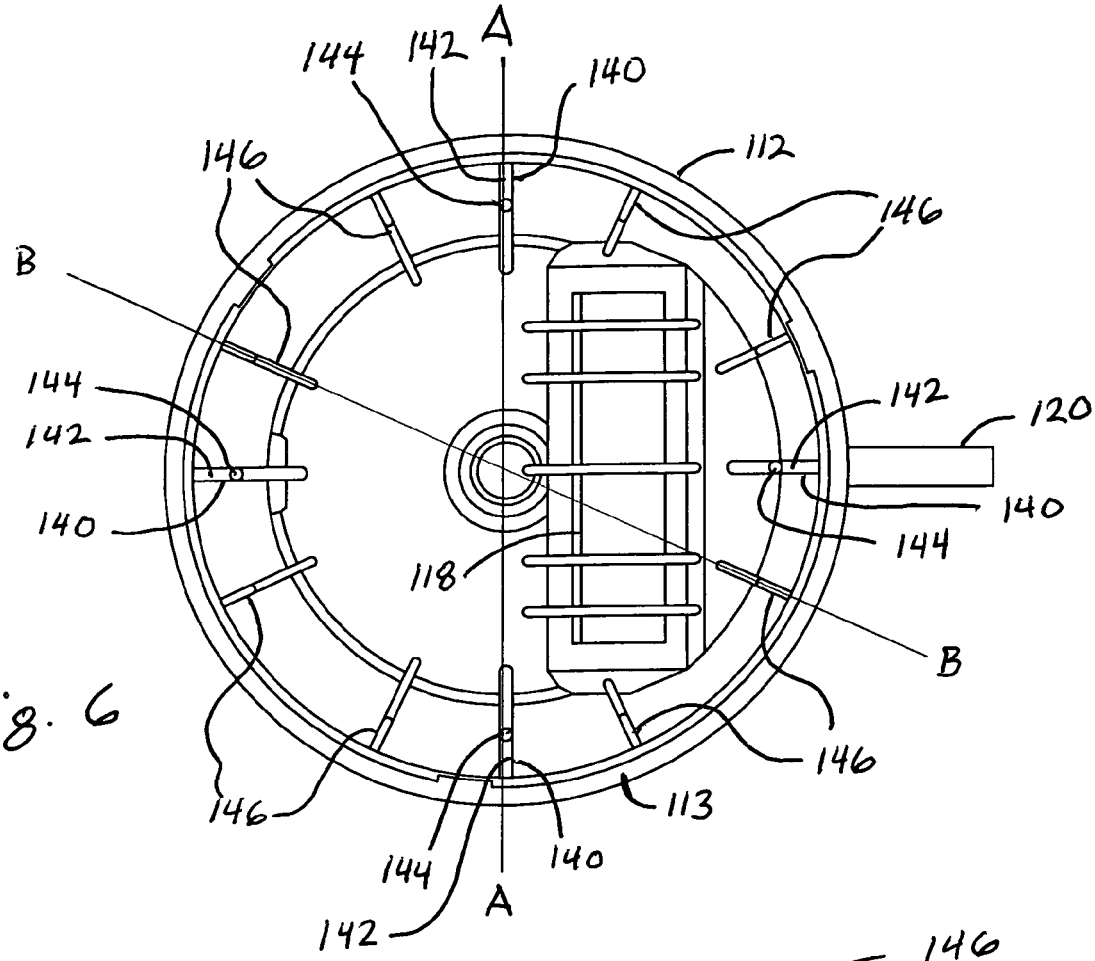
FIG. 6 is a top view of a bag chamber of an embodiment of the present invention.
Figure 7:
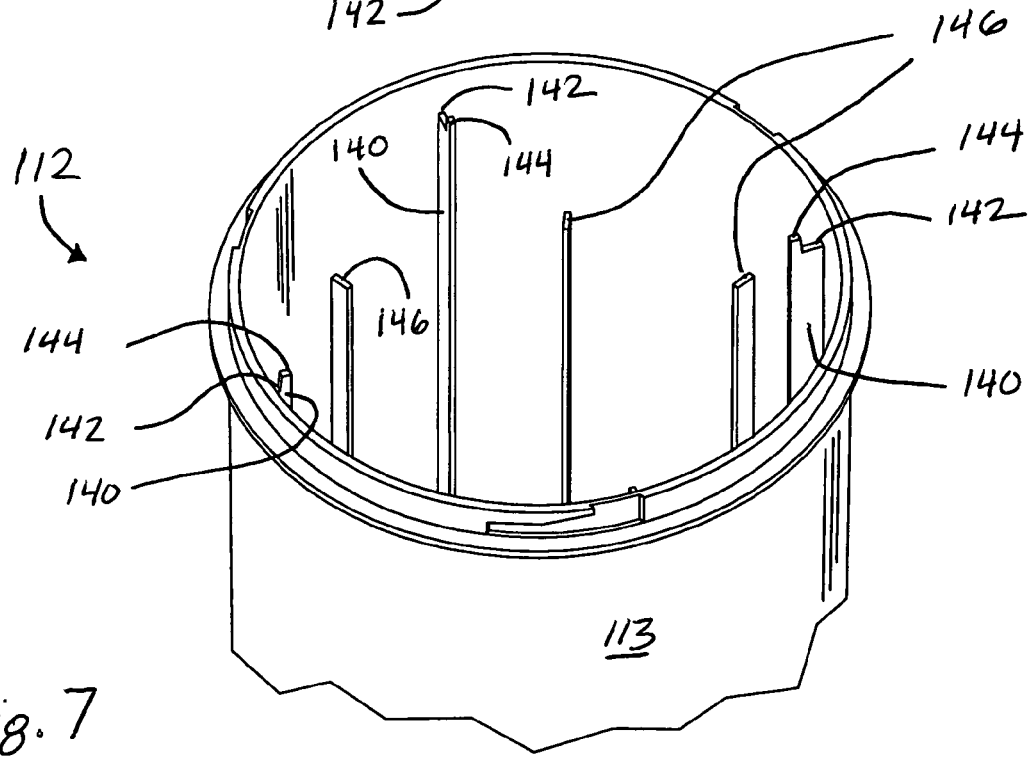
FIG. 7 is perspective drawing of the bag chamber of the embodiment shown in FIG. 6.

Referring now to FIGS. 6 and 7, an exemplary preferred embodiment of the bag chamber 112 is further constructed with a plurality of locator ribs 140 that extend from the interior surface bag chamber sidewall 113 toward the center of the bag chamber 112. In this preferred embodiment, the chamber 112 is generally cylindrical or frustoconical, and the locator ribs 140 extend in a generally radial direction relative to the chamber 112. In one preferred embodiment, there are four locator ribs 140, located at 90° increments as measured from a central vertical axis of the bag chamber 112. The locator ribs 140 preferably begin at the bottom end of the bag chamber 112 and taper, preferably with the minimum draft angle required for the molding if a molding process is used, to their termination at a level near, and preferably below, the top opening of the bag chamber 112. The top portion of each locator rib 140 includes a landing 142 and a locator pin 144. The locator pins 144 can comprise a protrusion having any shape, such as a cylindrical shape, a rectangular shape, and so on. The landing 142 is adjacent to the bag chamber sidewall 113 interior surface, and is sized to fit a support segment 143 (see FIG. 8) of the filter bag flange 116. The locator pin 144 preferably is radially inward of and adjacent to the landing 142—that is, the landings 142 are between the pins 144 and the interior surface of the sidewall 113.

The bag chamber 112 may also include one or more airflow-assisting ribs 146. These ribs 146 act to space the air permeable filter bag 102 away from the inner sidewalls 113 of the bag chamber 112 and thus allow for uniform and full aspiration around the entire outer surface of the filter bag 102.

Figure 8:
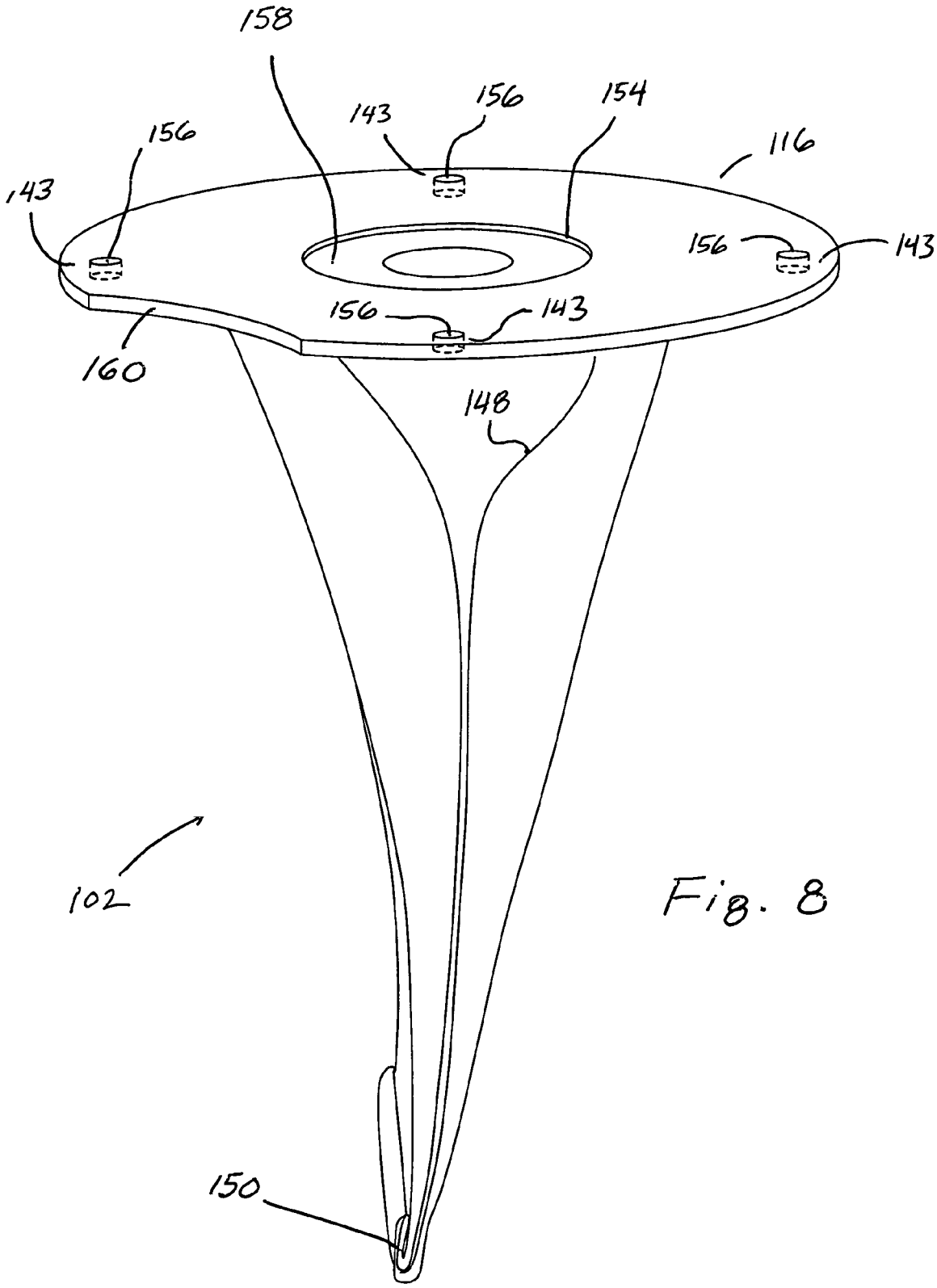
FIGS. 8 is an embodiment of a filter bag assembly of the present invention.

Referring now to FIG. 8, the filter bag 102 is constructed of filter paper, non-woven synthetic materials, other known materials. Preferably, the filter bag 102 has pleated side folds 148, a rolled and glued termination 150 at one end, and a generally rectangular or square "box" style shape at the other end. The box-shaped end is attached to a flange 116, and the flange 116 includes a hole 154 that fits over the mounting tube 122, and through which dust-laden air drawn into the device by the vacuum fan can enter the interior of the filter bag 102. A latex seal 158 may be captured between or attached to the filter bag 102 box end and/or the flange 116, as known in the art. The latex seal 158 is provided to enhance the seal between the filter bag inlet 154 and the mounting tube 122, and includes an opening 152 having a diameter smaller than the bag inlet 154 that seals around the mounting tube 122. The flange 116 preferably, but not necessarily, is oriented on the filter bag 102 so that a proper installation of the flange 116 aligns the rolled and glued termination 150 at the end of the filter bag 102 with respect to the outlet 118 at the bottom of the bag chamber 112 in such a manner that the rolled and glued termination 150 is generally parallel with axis A-A, shown in FIG. 6. This arrangement is expected to allow more efficient airflow through the assembled bag chamber 112 and lid 114, and allow the operator to get the full use of the filter bag 102. The aspects of the present invention that allow for the proper alignment of the flange 116, and thus the filter bag 102, are described elsewhere herein.

The flange 116 may be constructed of conventional materials, such as 2-ply chipboard, plastic, or the like, and is attached to the filter bag 102 by conventional processes such as gluing, stitching, heat bonding, and so on. One embodiment of the present invention utilizes a flange 116 that has a shape that closely conforms to that of the open end of the bag chamber 112 and any orienting or mounting features within the cup, but this close fit is not required. The outer perimeter of the flange 116 in this embodiment fits just inside the inner surface of the bag chamber 112. The flange 116 contains locator openings 156 spaced inwardly from the outer perimeter. These locator openings 156 cooperate with the locator pins 144 to positively position the assembled filter bag 102 and flange 116 inside the bag chamber 112. The pins 144 further prevent the flange 116 from turning while in operation and resist any bending force that might occur when air is flowing through the filter bag 102 during operation or when supporting the collected dirt in the filter bag 102 during storage. While it is preferred to form the openings 156 prior to distributing the filter bag 102 to consumers, it is also envisioned for the flange 116 to be accompanied with instructions for the operator to make the locator openings 156 or perforations, either by cutting them out or removing existing perforated regions of the flange 116. Radially outward of the openings 156 are support segments 143 of the flange 116. These segments rest on the landings 142 of the locator ribs 140 and fit within the space between the locator pins 144 and the inner surface of the bag chamber 112.

Figure 9:
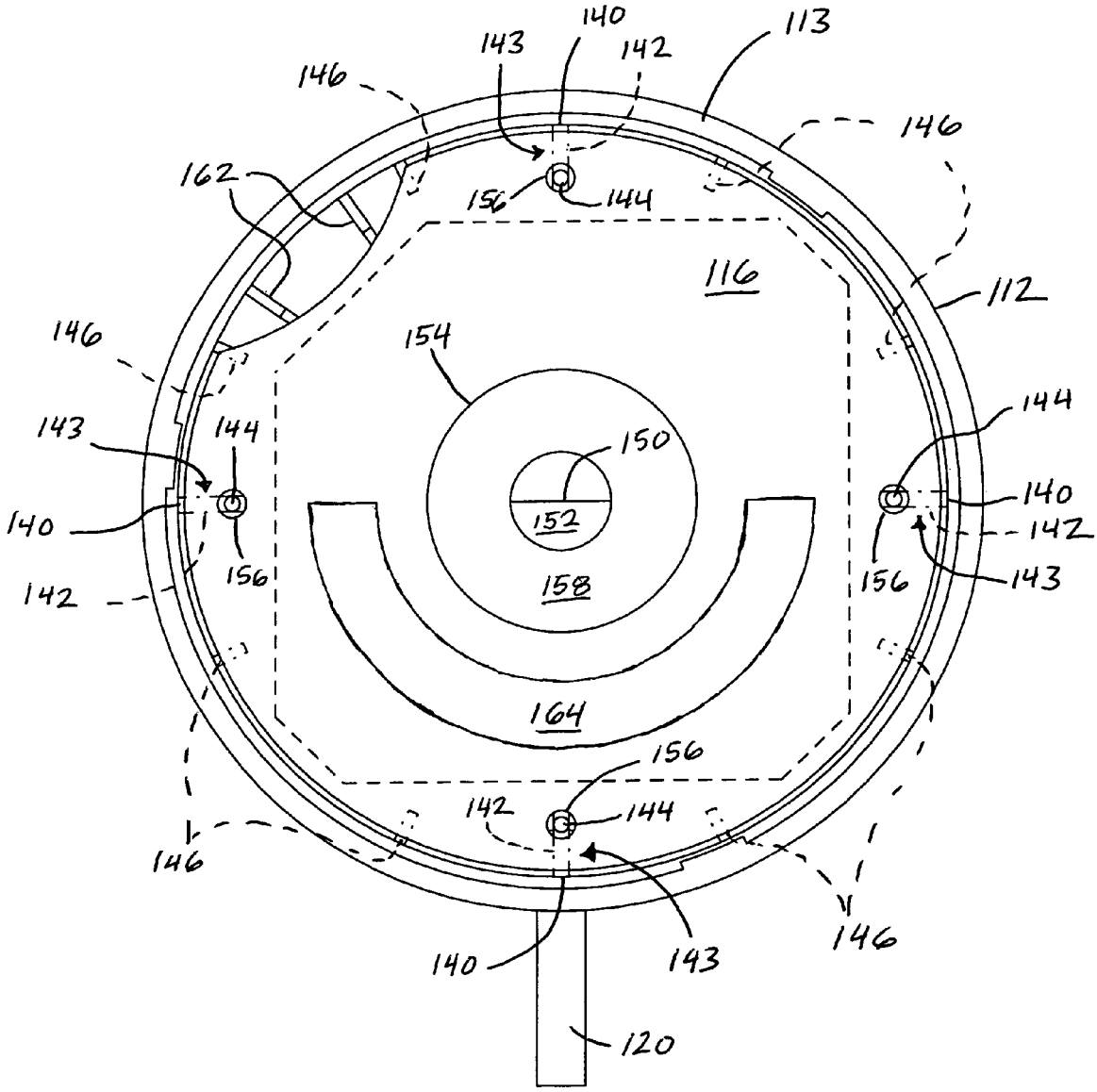
FIG. 9 is a top view of the bag chamber of FIG. 6 assembled with the filter bag of FIG. 8.

Referring now to FIG. 9, it also may is desirable, but is not necessary, to provide features to help align the filter bag 102 in the bag chamber 112 in a particular orientation. For example, locating features 162 comprising radially-extending rib-like structures may be provided at the top portion of the bag chamber 112 at the level of the flange 116. Cutouts 160 in the flange 116 are provided to receive, either loosely or with close tolerances, these locating features 162. FIG. 9 depicts how these additional locating features 162 fit into the corresponding cutouts 160 in the flange 116 in the shown exemplary embodiment. The flange 116 preferably will not fit properly within the bag chamber 112 until the user orients the filter bag 102 with the cutout 160 with the locating features 162. At this location, the lower seam 150 of the bag may be oriented as intended by the manufacturer. Until such time, the flange 116 preferably will interfere with the user's ability to secure the lid 114 on the chamber 112. In FIG. 9, as well as FIGS. 11-18, the connection between the bag and flange 116 is shown by an exemplary broken line around or near the outer edge of the flange 116.

An added feature of the foregoing embodiment is that the flange cutout 160 may also provide a location in which the user can insert a finger to help remove the filter bag 102 for replacement. Of course, such a cutout 160 may also be provided to give access for a user's finger even if no additional locating features 162 are provided. While the shown embodiment uses a single cutout 160 and corresponding locating feature or features 162, a further embodiment may provide the flange 116 with symmetrical cutouts to facilitate orientations in 180° rotational increments (not shown), 90° and so on.

The flange 116 optionally further comprises a handle 164 (shown by dotted lines in FIG. 9). The handle 164 is formed of a single ply of chipboard and is pivotable to a position above the plane of the flange 116 for easy access and lifting by the operator when removal of the filter bag 102 from the bag chamber 112 is required. The handle has a relief (void area) from the full round form that allows finger access between the inside surface of the bag chamber 112 and the handle 164 for easy gripping access during removal. Alternatively, the handle 164 may be constructed as a larger semi-circle and form a portion of the support segments 143 for the filter bag 102 when installed in the bag chamber 112.

Figure 10A:
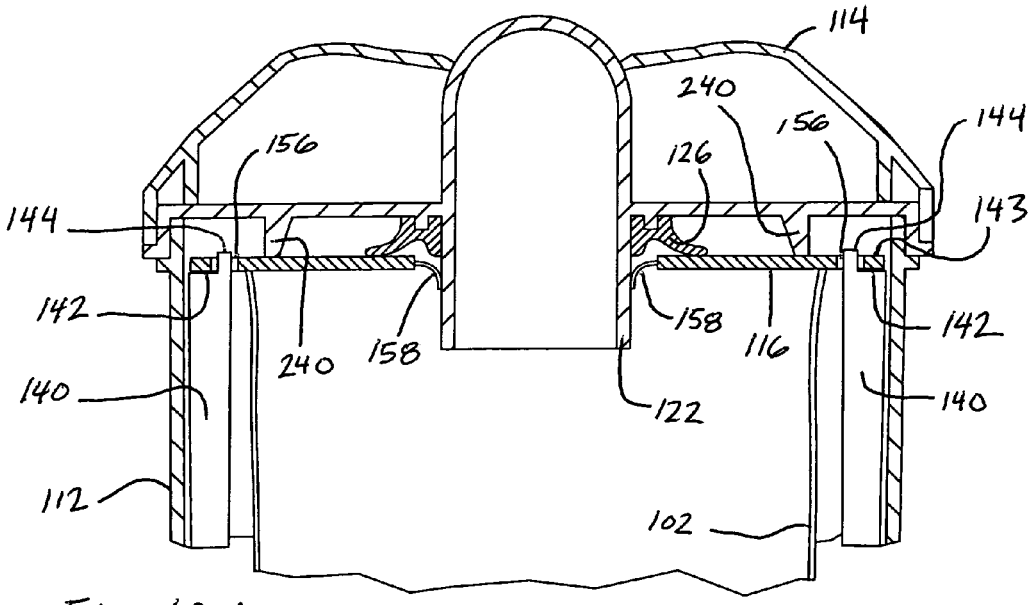
FIG. 10A is a cross-sectional view of the assembled bag chamber and lid, shown along line A-A of FIG. 6.
Figure 10B:
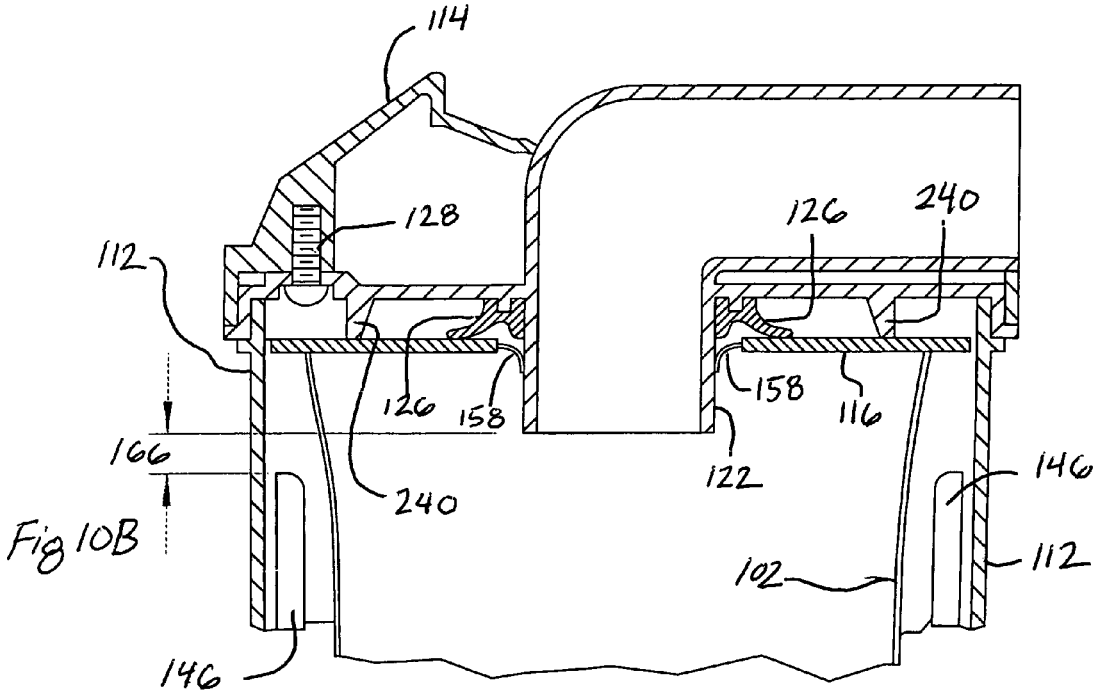
FIG. 10B is a cross-sectional view of the assembled bag chamber and lid, shown along line B-B of FIG. 6.

With reference now to FIGS. 10A and 10B, in the shown embodiment, the orientation and placement of the filter bag 102 is facilitated by the relationship between the locator pins 144 and locator openings 156, and the landings 142 and support segments 143. To install the filter bag 102 into the bag chamber 112, the operator aligns the locator pins 144 so that they project through the locator openings 156. This arrangement allows the support segments 143 to rest on the locator rib landing 142 and support the flange 116 and the rest of the filter bag 102 against the suction of the vacuum fan, and, in those embodiments in which the filter bag 102 is oriented vertically, from falling into the bag chamber 112 under the weight of the bag or the dirt collected within the filter bag 102. The landings 142 and support segments 143 also may hold the flange 116 against the gasket 126 to form a seal between the mounting tube 122 and the flange 116, thus inhibiting dust-laden air in the vacuum air stream from escaping and/or inhibiting ambient air from leaking into the bag at this junction.

The operator preferably will be able to tell that the flange 116, and thus the filter bag 102, is properly installed by observing that the locator pins 144 protrude through the locator openings 156. If the filter bag 102 is inserted incorrectly or an improper bag is used, the operator will be unable to see the locator pins 144 protruding through the locator openings 156. Improper installation of the filter bag 102 or use of an improper bag may alternatively or additionally cause the flange 116 to rest on top of the locator pins 144 instead of the landings 142, in which position one or more protrusions 240 or other features on the underside of the lid 116 may contact the flange 116 and prevent or inhibit the lid 114 from being secured to the bag chamber 112.

In this or other embodiments, if the operator attempts to install a filter bag 102 that is too small, it may fall into the bag chamber 112 or rest on the airflow-assisting ribs 146, which are located below the level of the landings 142. In such an embodiment, the mounting tube 122 may terminate somewhat above the airflow-assisting ribs 146, leaving a gap 166 therebetween. In this case, an improper filter bag 102 that is resting by its flange 116 on the airflow-assisting ribs 146, will not seal over the mounting tube 122. This gap 166 will short-circuit the airflow passage from the inlet nozzle 108 to the vacuum fan, essentially preventing improper use with an undersized or incorrect filter bag 102.

Using the foregoing embodiment, it is likely to be obvious to an operator in many or most instances in which the filter bag's flange 116 is too large, too small, or simply improperly aligned.

In another embodiment, the lid 114 may be provided with a substantial airflow opening (not shown), such as a simple hole that leads to ambient air. A portion of the flange 116 is positioned to block this opening when it is properly installed. In this embodiment, if the vacuum bag is not installed (or improperly installed, if so constructed), the opening will short-circuit the airflow path, and the vacuum will draw clean air into the vacuum motor through the opening, rather than dirty air from the vacuum nozzle or accessory tool. This protects the motor in the event a user attempts to operate it without a filter bag assembly. Such an opening is preferably shielded from view for aesthetic reasons and to prevent accidental ingestion of objects set on top of the lid 114.

Figure 11:
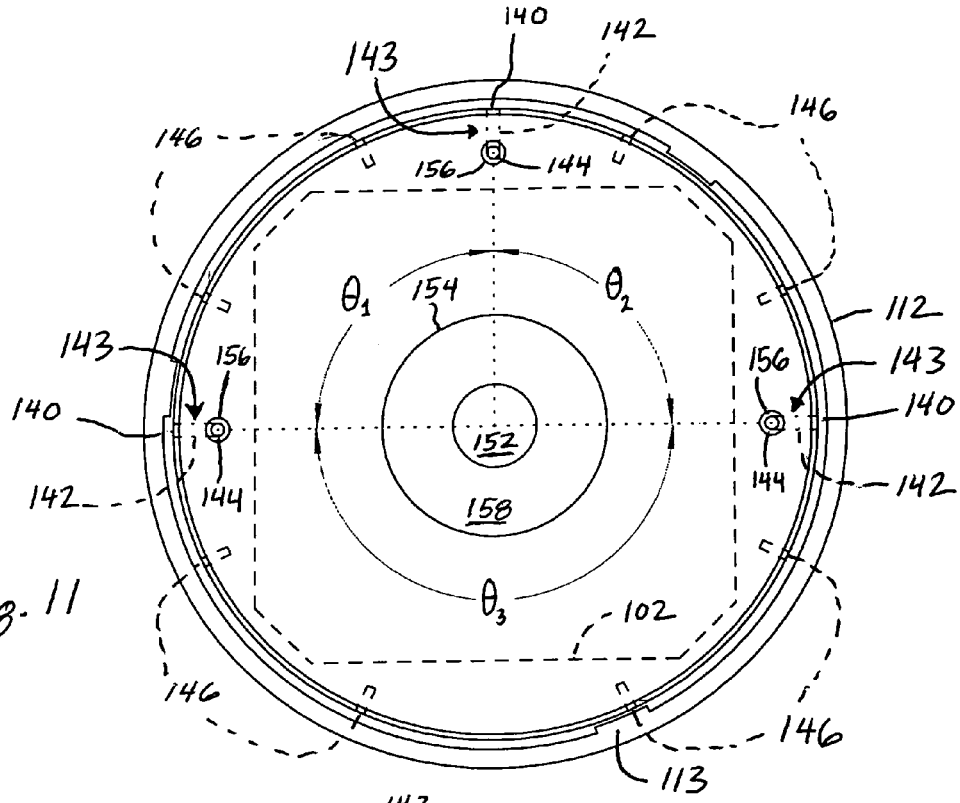
FIGS. 11-18 are various additional top views of exemplary embodiments of filter bag flanges of the present invention.
Figure 12:
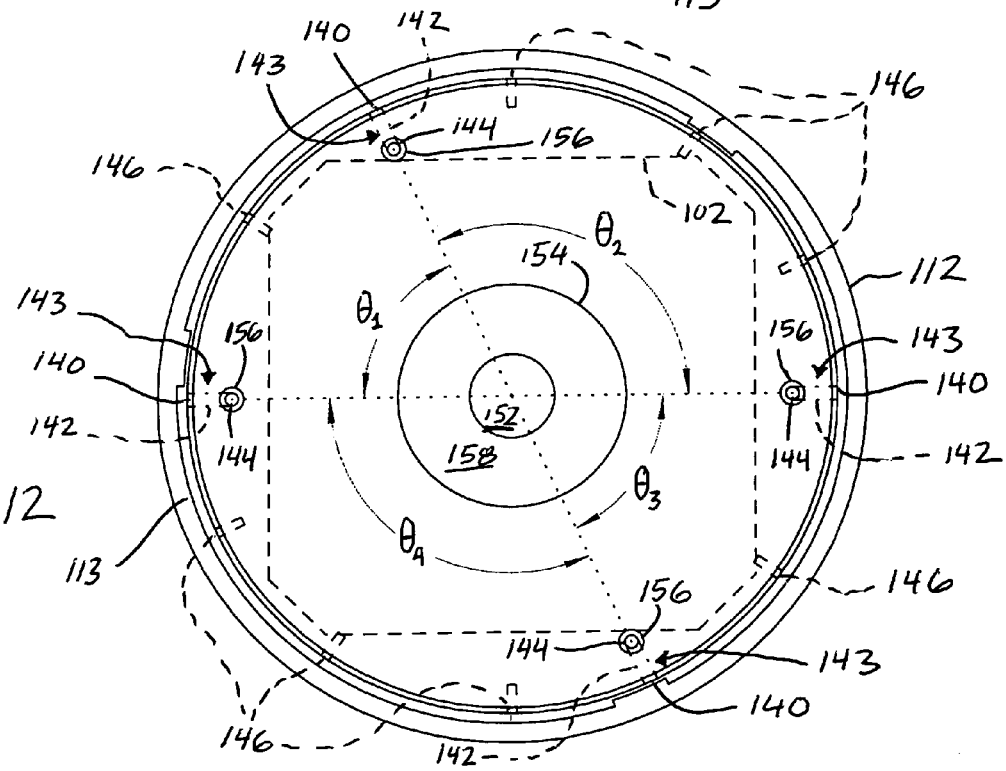
Figure 13:
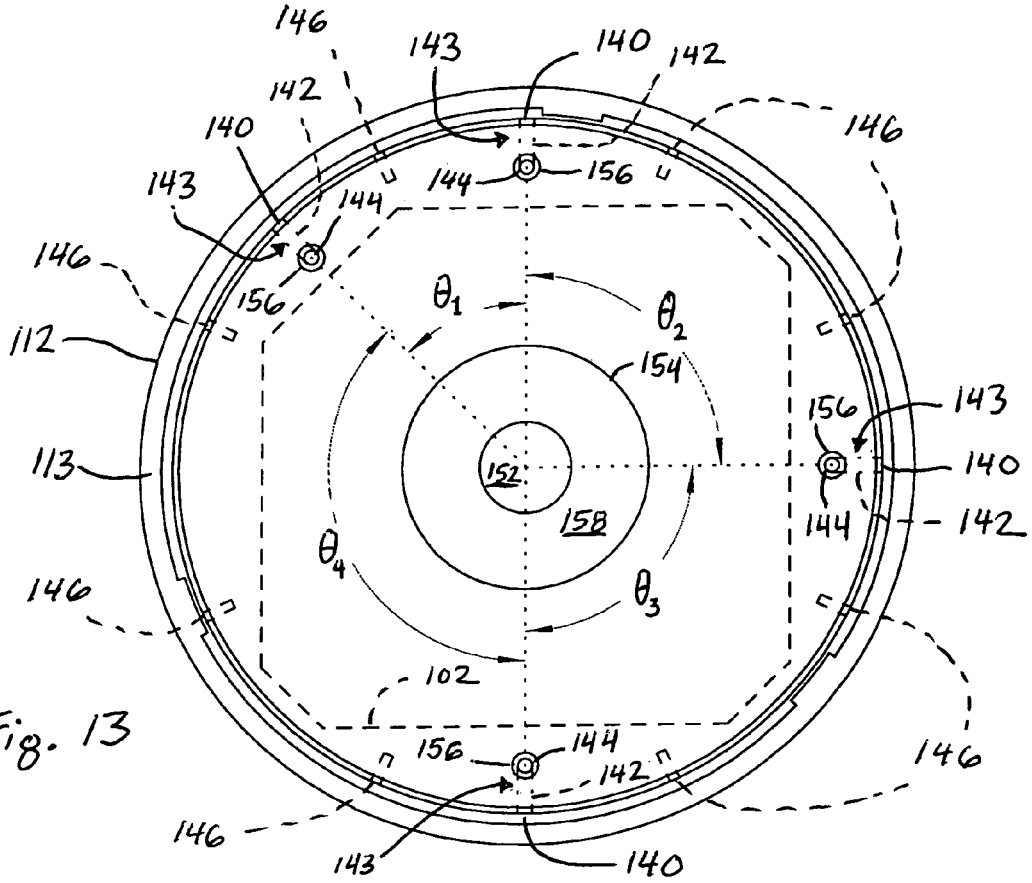

The foregoing embodiment discloses a number of protective features to inhibit or prevent users from operating the vacuum cleaner with an improper filter bag. A number of additional non-limiting variations on the foregoing embodiments are also envisioned. For example, FIGS. 11 through 18 show other locator pin 144 and opening 156 arrangements. FIG. 11 depicts only three locator pins 144 and three corresponding locator openings 156, where at least one angle is not equal to the others ($\theta_1 \neq \theta_2$, $\theta_1 \neq \theta_3$), thus allowing for only one proper alignment of the flange 116 (and thus the filter bag) in the bag chamber 112. FIG. 12 depicts four locator ribs 102 located where angles $\theta_1$ and $\theta_3$ are equal and angles $\theta_2$ and $\theta_4$ are equal. This arrangement allows for two possible orientations. FIG. 13 is similar to FIG. 12, but shows four locator ribs having pins 144 and landings 142 at various different angular variations to ensure only one proper orientation ($\theta_1 \neq \theta_2 \neq \theta_3 = \theta_4$).

Figure 14:
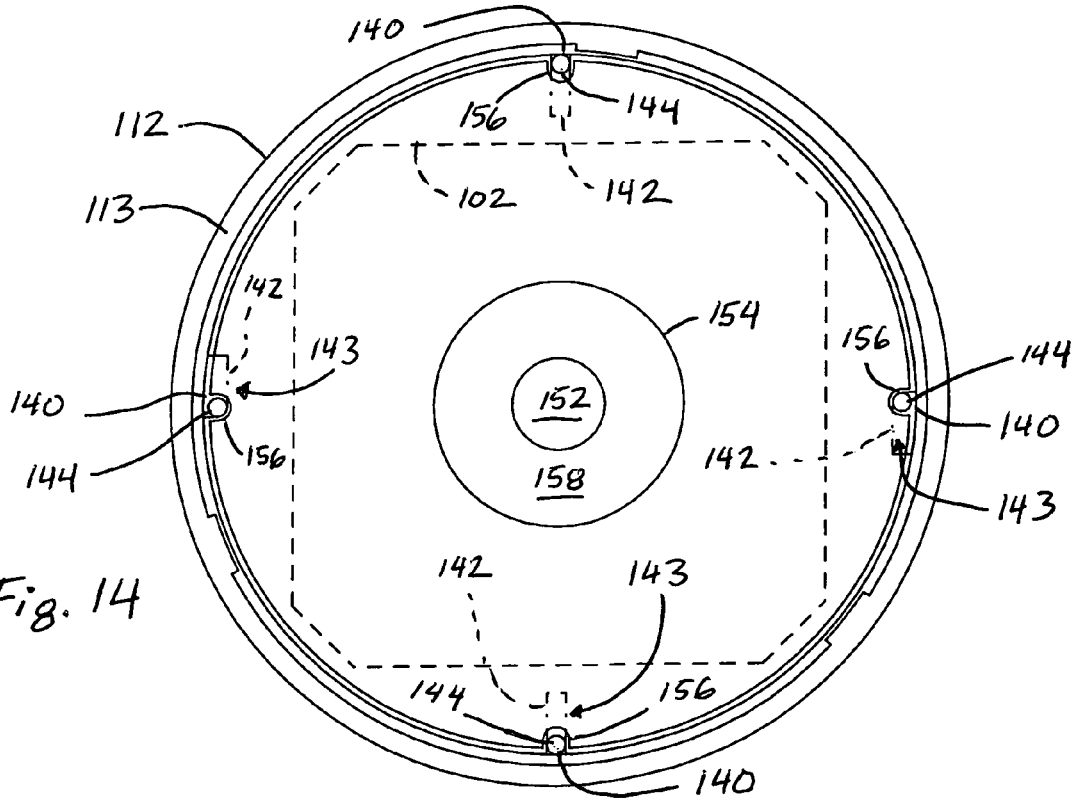

It will also be appreciated that the landings 142 and pins 144 may have various different positional relationships relative to one another and the bag chamber wall, as shown in FIG. 14. For example, in this embodiment, the locator pins 144 and landings 142 on the left and right sides of the exemplary embodiment are located radially parallel to one another (e.g., the pins and landings are equally-spaced from the bag chamber sidewall 113). This exemplary embodiment also shows an inverted orientation of the pins 144 and landings 142 (i.e., with the pins outward of the landings with respect to the center of the bag chamber), as shown in the pins and landings at the top and bottom of the embodiment. Of course, other variations are possible.

Still other variations are envisioned and possible with the present invention. For example, the pins 144 and landings 142 may be formed on the lid 114, with conventional ribs or other protrusions located in the bag chamber 112 to clamp the flange 116 therebetween when the lid is installed. It is further envisioned that the pins may be formed as protrusions on the flange 116 that fit into voids or holes in the ribs or into a flat surface around the perimeter of the bag chamber 112 or lid 114.

Figure 15:
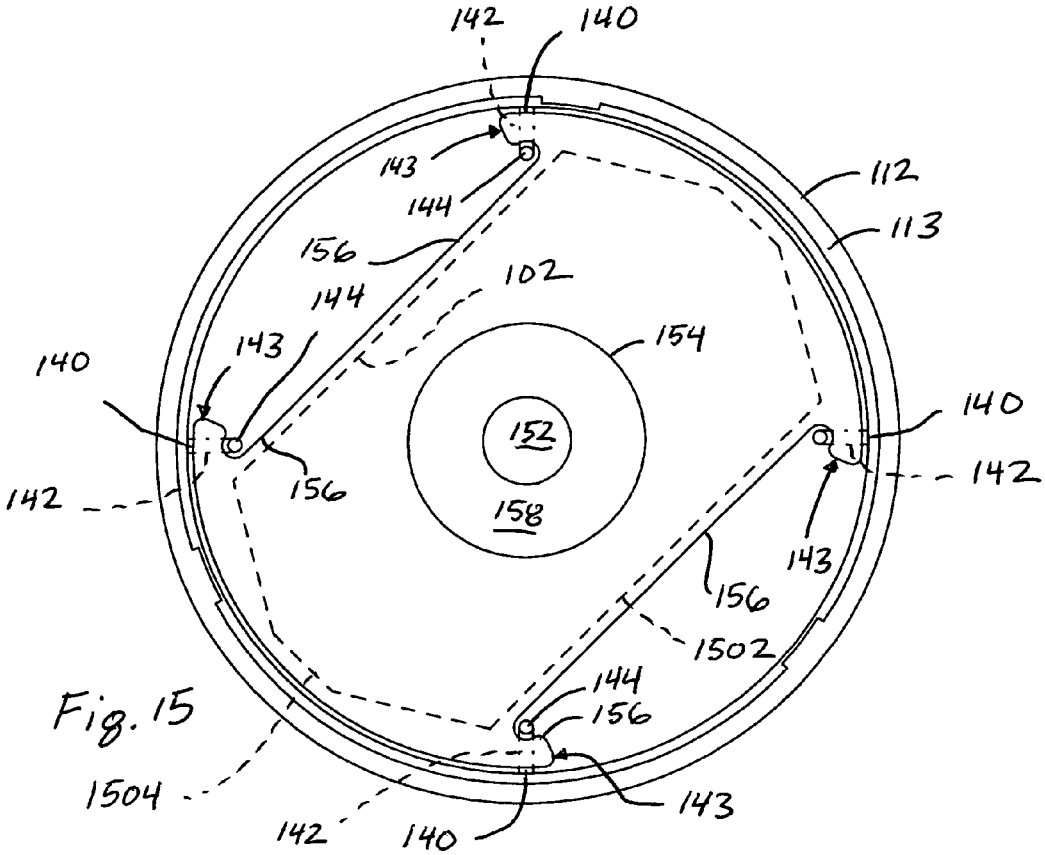

FIG. 15 depicts another variation in which the flange 116 has openings 156 that correspond to the locator pins 144, but, unlike the previous embodiments, the openings 156 are not discrete holes—that is, they comprise slots or other shapes that are formed continuously with the outer perimeter of the flange 116. In this embodiment, the flange 116 is constructed to have openings 156 to prevent interference with the locator pins 144 and has support segments 143 appropriately located to rest on the landings 142. As shown, the flange 116 may have a generally rectangular shape with two rounded edges 1502 and two straight edges 1504, or other shapes that do not mimic or follow the shape of the bag chamber wall 113.

Figure 16:
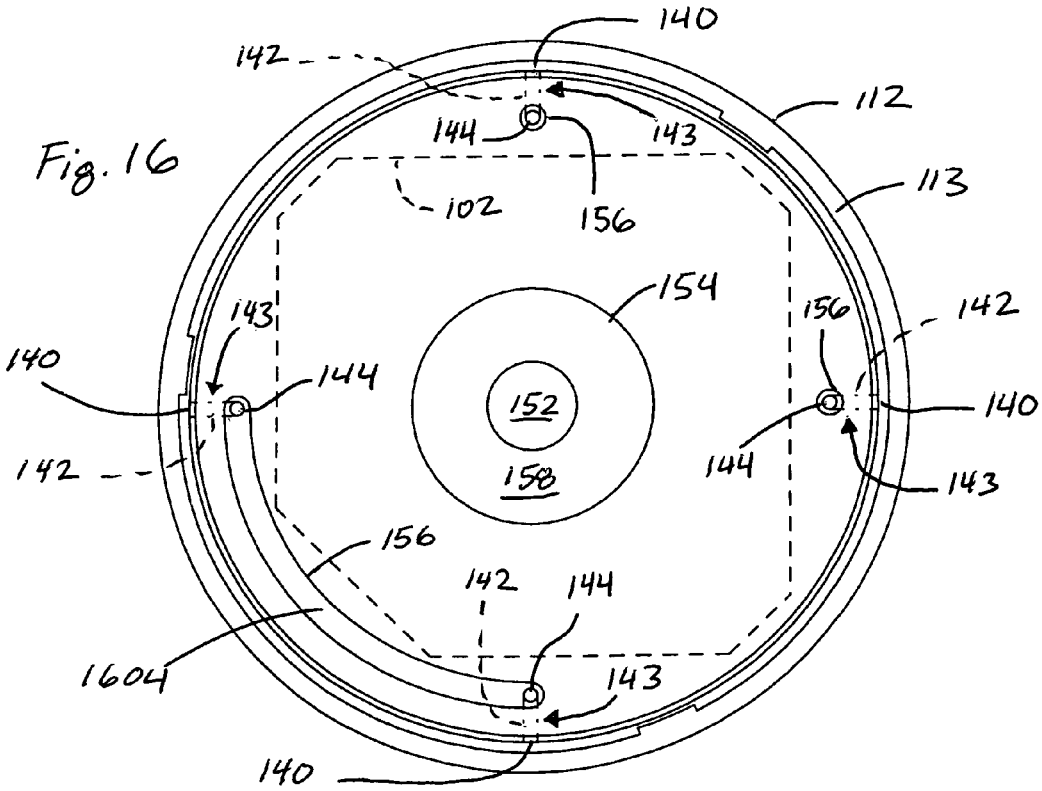

FIG. 16 illustrates yet another exemplary embodiment of a flange 116 in which two locator openings 156 are provided to correspond to two locator pins 144, and a single opening 1604 receiving two or more locator pins 144. The single opening 1604 is shaped as a slot forming an arc-like opening near the perimeter of the flange 116, but may have other shapes.

Figure 17:
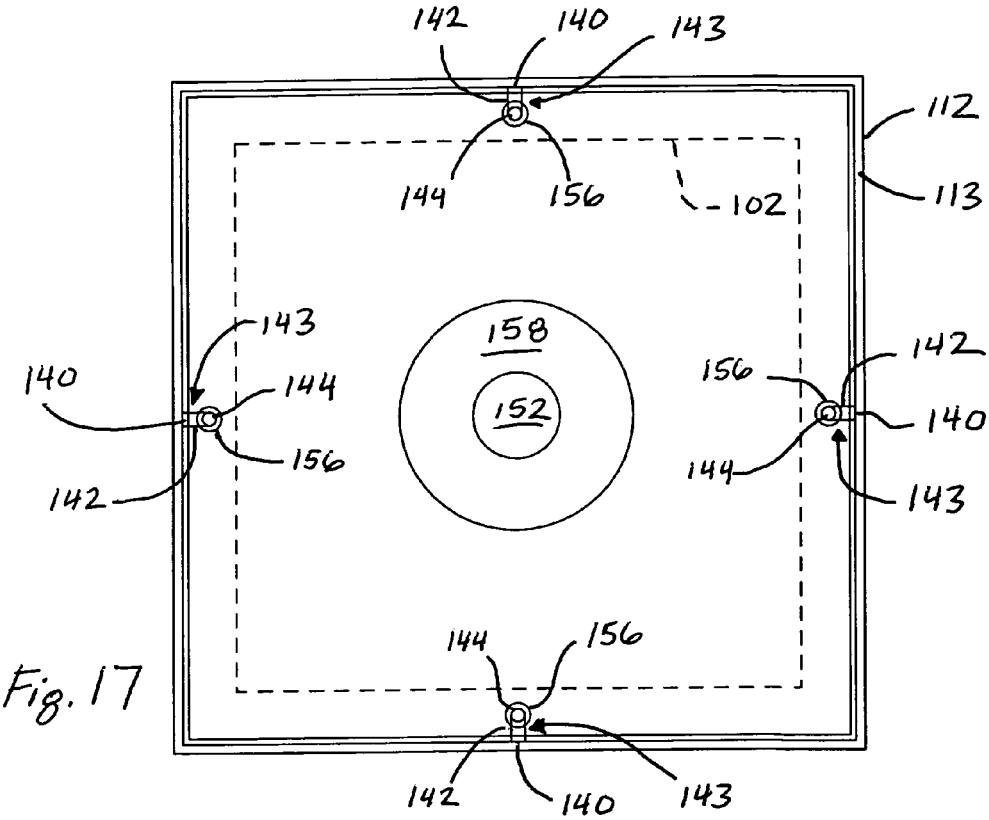

FIG. 17 depicts still another exemplary embodiment of a flange 116 and bag chamber 112, in which the bag chamber 112 and flange 116 have a non-circular shape, such as a square or rectangular shape. The flange 116 preferably is mounted in the bag chamber 112 upon a set of locator pins 144, as with other embodiments described previously herein.

Figure 18:
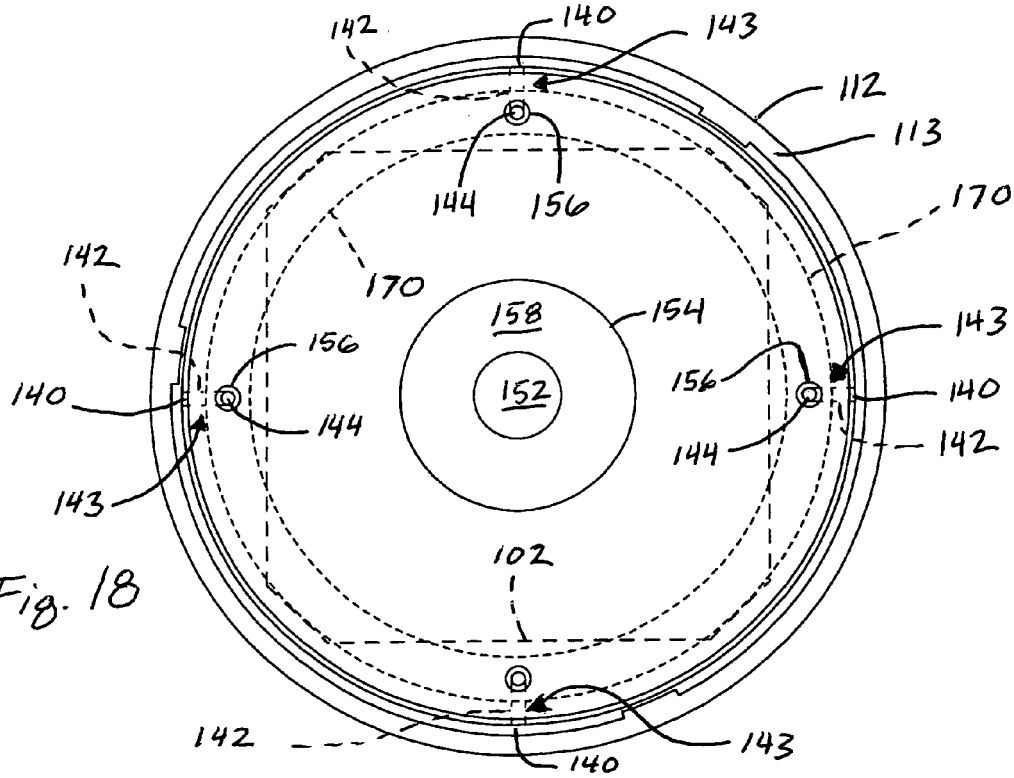

FIG. 18 depicts another embodiment in which the flange 116 includes a band of reinforcing material 170 around the outer perimeter of the flange 116. The reinforcing material 170 passes through one or more of the support segments 143 and may overlap the locator openings 156. Alternatively, the reinforcing material 170 may only run through the support segments 143. The reinforcing material 170 can be made of the same material as that of the flange 116 or alternatively could be a thin metal washer, a wire, or other reinforcing material. The purpose of this added material is to strengthen the support segment 143.

Figure 19:
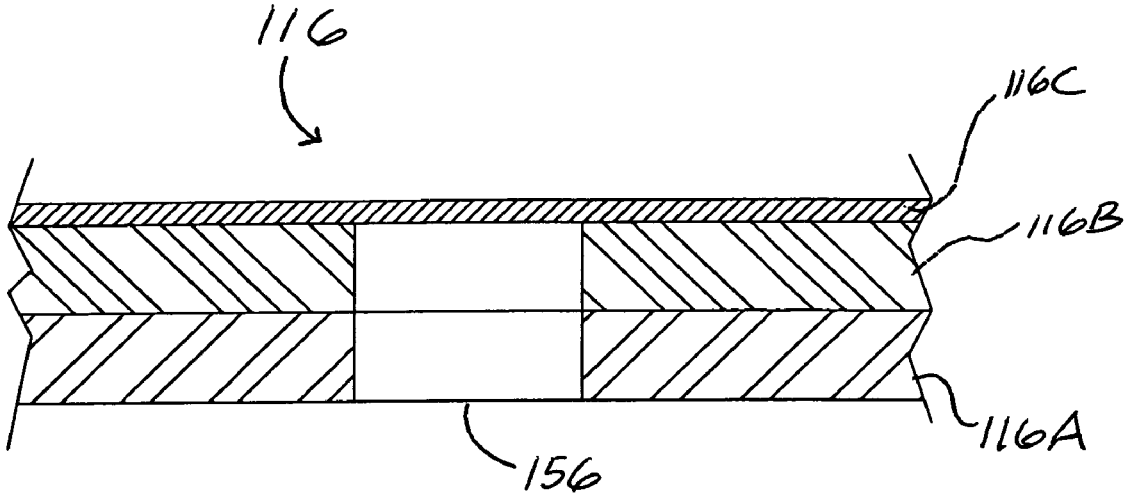
FIG. 19 is a fragmented, cutaway side view of an alternative embodiment of a filter bag flange and locator opening of the present invention.

FIG. 19 illustrates still another embodiment of the present invention in which the opening 156 does not pass through the entire flange 116. In this embodiment, the openings 156 may be formed by molding them into a plastic flange 116, or if the flange 116 is constructed of multiple plies 116A, 116B, 116C, it may possible to form an opening 156 through one or more layers 116A, 116B but not form the opening 156 through the remaining layers 116C. In this embodiment, the remaining portion 116C of the flange 116 preferably is sized so that it does not interfere with the closing of the bag chamber lid 114 when the flange 116 is properly oriented.

It should be understood that the foregoing embodiments are exemplary only, and other embodiments will be apparent to those of ordinary skill in the art in light of the teachings provided herein. The various inventive concepts described herein are not limited to being practiced together, and may be used in any number of combinations with any number of devices. Furthermore, while the foregoing description illustrates the use of various embodiments in conjunction with the use of a filter bag, it will be understood that the embodiments described with respect to each device may also be used with various types of flat or pleated filters as used in other cyclonic and non-cyclonic vacuum cleaners. Further, the locations of the bag chamber inlet and outlet can be reversed or reoriented, and it is also envisioned to create a flange with any combination of the above styles of locator openings. Other variations will be apparent to those of ordinary skill in the art in view of the present disclosure and with practice of the invention.

We claim:

1. A vacuum cleaner dirt containment system comprising:

a bag chamber associated with a vacuum cleaner housing, the bag chamber comprising:

an open end, an outlet adapted to be in fluid communication with a vacuum fan inlet located on the vacuum cleaner housing, and a plurality of locator ribs extending from an inner wall of the bag chamber, each locator rib having a landing adjacent an inner wall of the bag chamber, and a pin located inward of the landing and extending from the landing towards the open end of the bag chamber;

a filter bag assembly adapted to be inserted into the open end of the bag chamber, the filter bag comprising:

a bag formed at least partially of an air-permeable material, and a flange attached to an open end of the bag and having a flange air inlet passing through the flange into the bag, the flange having a plurality of openings located to be inserted over one or more of the locator rib pins, and a plurality of support segments located to abut one or more of the locator rib landings when the openings are located over the locator rib pins; and a lid selectively attachable to the open end of the bag chamber, the lid comprising an air inlet mounting tube that extends into the flange air inlet when the lid is attached to the open end of the bag chamber.

2. The vacuum cleaner dirt containment system of claim 1, wherein:

the bag chamber is generally cylindrical; and the plurality of locator ribs are oriented at angles greater than or equal to 90° about the centerline of the bag chamber.

3. The vacuum cleaner dirt containment system of claim 1, wherein the pins are oriented such that the plurality of openings can be inserted over the pins only when the flange is positioned in one general orientation.

4. The vacuum cleaner dirt containment system of claim 1, wherein the flange comprises one or more reinforcing materials that pass through one or more of the support segments.

5. The vacuum cleaner dirt containment system of claim 1, wherein the flange rests upon at least one of the pins when the flange is improperly oriented, and the lid further comprises one or more surfaces adapted to abut the flange when the flange is improperly installed and thereby inhibit the lid from being attached to the bag chamber.

6. The vacuum cleaner dirt containment system of claim 1, wherein the openings do not pass completely through the flange.

7. The vacuum cleaner dirt containment system of claim 1, wherein at least one opening is adapted to be inserted over two or more pins.

8. The vacuum cleaner dirt containment system of claim 1, wherein the bag chamber further comprises airflow-assisting ribs extending from the inner surface of the bag chamber.

9. The vacuum cleaner dirt containment system of claim 8, wherein the airflow-assisting ribs are positioned such that the flange does not rest on them when properly inserted in the bag chamber.

10. The vacuum cleaner dirt containment system of claim 1, wherein the flange air inlet does not surround the air inlet mounting tube when the flange is inserted into the bag chamber beyond the landings.

11. The vacuum cleaner dirt containment system of claim 1, wherein the bag chamber is removable from the vacuum cleaner housing.

12. The vacuum cleaner dirt containment system of claim 11, wherein the lid is associated with the vacuum cleaner housing.

13. The vacuum cleaner dirt containment system of claim 12, wherein the lid is removable from the vacuum cleaner housing when the lid is attached to the bag chamber.

14. The vacuum cleaner dirt containment system of claim 13, wherein the lid comprises a latch adapted to selectively attach the lid to the vacuum cleaner housing.

15. A vacuum cleaner filter bag comprising:

a bag formed at least partially of an air-permeable material; and a flange attached to an open end of the bag and having a flange air inlet passing through the flange into the bag, the flange having one or more discrete openings adapted to facilitate proper alignment of the filter bag, and a seal extending radially inwardly from the flange air inlet.

16. The vacuum cleaner filter bag of claim 15, wherein the openings are oriented at angles of at least 90° relative to each other about a centerline of the filter bag.

17. The vacuum cleaner filter bag of claim 15, wherein the openings do not pass completely through the flange.

18. A vacuum cleaner dirt containment system comprising:

a bag chamber removably associated with a vacuum cleaner housing, the bag chamber comprising an open end and an outlet adapted to be in fluid communication with a vacuum fan inlet located on the vacuum cleaner housing;

a filter bag assembly adapted to be inserted into the open end of the bag chamber, the filter bag comprising a bag formed at least partially of an air-permeable material, and a flange attached to an open end of the bag and having a flange air inlet passing through the flange into the bag; and a lid selectively attachable to the open end of the bag chamber, the lid comprising an air inlet mounting tube that extends into the flange air inlet when the lid is attached to the open end of the bag chamber;

wherein the flange is captured in place between the bag chamber and the lid.

19. The vacuum cleaner dirt containment system of claim 18, wherein the lid is associated with the vacuum cleaner housing.

20. The vacuum cleaner dirt containment system of claim 19, wherein the lid is removable from the vacuum cleaner housing when the lid is attached to the bag chamber.

21. The vacuum cleaner dirt containment system of claim 20, wherein the lid comprises a latch adapted to selectively attach the lid to the vacuum cleaner housing.

22. The vacuum cleaner dirt containment system of claim 18, wherein:

the bag chamber further comprises a plurality of locator ribs extending from an inner wall of the bag chamber, each locator rib having a landing adjacent an inner wall of the bag chamber, and a pin located inward of the landing and extending from the landing towards the open end of the bag chamber; and the filter bag flange further comprises a plurality of openings located to be inserted over one or more of the locator rib pins, and a plurality of support segments located to abut one or more of the locator rib landings when the openings are located over the locator rib pins.

23. The vacuum cleaner dirt containment system of claim 18, wherein the bag chamber is generally cylindrical.

24. The vacuum cleaner filter bag of claim 15, wherein the openings are arranged in a concentric circle around the flange air inlet.

* * * * *

UNITED STATES PATENT AND TRADEMARK OFFICE

CERTIFICATE OF CORRECTION

PATENT NO. : 7,662,200 B2
APPLICATION NO. : 11/582382
DATED : February 16, 2010
INVENTOR(S) : Knuth et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 675 days.

Signed and Sealed this

Twenty-eighth Day of December, 2010

David J. Kappos

David J. Kappos
*Director of the United States Patent and Trademark Office*